US009390680B2

(12) United States Patent
Jeon et al.

(10) Patent No.: US 9,390,680 B2
(45) Date of Patent: Jul. 12, 2016

(54) LIQUID CRYSTAL DISPLAY DEVICE

(71) Applicant: LG DISPLAY CO., LTD., Seoul (KR)

(72) Inventors: Woo Jin Jeon, Daegu (KR); Min Hwa Kim, Daegu (KR); Kyu Man Lee, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 282 days.

(21) Appl. No.: 13/722,712

(22) Filed: Dec. 20, 2012

(65) Prior Publication Data

US 2013/0249969 A1 Sep. 26, 2013

(30) Foreign Application Priority Data

Mar. 23, 2012 (KR) ..... 10-2012-0030167

(51) Int. Cl.
*G09G 3/36* (2006.01)
*G09G 5/10* (2006.01)

(52) U.S. Cl.
CPC .. *G09G 5/10* (2013.01); *G09G 3/36* (2013.01); *G09G 3/3685* (2013.01); *G09G 3/3696* (2013.01); *G09G 2300/0408* (2013.01); *G09G 2310/027* (2013.01); *G09G 2320/0276* (2013.01); *G09G 2320/0673* (2013.01)

(58) Field of Classification Search
CPC ..... G09G 2310/027; G09G 2320/0673; G09G 2320/0276; G09G 5/10; G09G 3/36; G09G 3/3685; G09G 3/3696; G09G 2300/0408
USPC ..... 345/87
See application file for complete search history.

(56) References Cited

U.S. PATENT DOCUMENTS

| | | | | |
|---|---|---|---|---|
| 5,495,287 | A | 2/1996 | Kasai et al. | |
| 2005/0225466 | A1 | 10/2005 | Yamaguchi | |
| 2006/0087483 | A1 * | 4/2006 | Takada et al. | 345/89 |
| 2006/0198009 | A1 * | 9/2006 | Morita | 359/245 |
| 2007/0139328 | A1 * | 6/2007 | Lan | 345/89 |
| 2007/0146395 | A1 | 6/2007 | Lee | |
| 2008/0001897 | A1 | 1/2008 | Lim | |
| 2009/0021462 | A1 * | 1/2009 | Furihata | G09G 3/2011 345/89 |

FOREIGN PATENT DOCUMENTS

| | | | |
|---|---|---|---|
| CN | 1804983 | A | 7/2006 |
| CN | 101025904 | A | 8/2007 |
| JP | 2002-366112 | | 12/2002 |
| JP | 2005-063294 | | 3/2005 |
| JP | 2005-300784 | | 10/2005 |

(Continued)

OTHER PUBLICATIONS

Office Action issued in corresponding Japanese Patent Application No. 2012-278162, mailed Mar. 4, 2014, 2 pages.

(Continued)

*Primary Examiner* — Jonathan Boyd
(74) *Attorney, Agent, or Firm* — Brinks Gilson & Lione

(57) ABSTRACT

An organic light emitting display device is disclosed which includes: a memory in which gamma setting data is stored; a data driver configured to include a gamma voltage generator; a timing controller configured to download the gamma setting data from the memory and apply a select signal to the gamma voltage generator; and a power supplier configured to apply reference voltages to the gamma voltage generator, wherein the select signal is used to vary a gamma curve by enabling the reference voltages to be adjusted in their levels.

10 Claims, 6 Drawing Sheets

(56) References Cited

FOREIGN PATENT DOCUMENTS

| | | | |
|---|---|---|---|
| JP | 2006-146134 | | 6/2006 |
| JP | 2006-243231 | | 9/2006 |
| JP | 2006-243232 | | 9/2006 |
| JP | 2010-286840 | | 12/2010 |
| WO | WO 2005/081218 | A1 | 9/2005 |
| WO | WO 2009/125614 | A1 | 10/2009 |

OTHER PUBLICATIONS

Extended European Search Report issued in corresponding European Patent Application No. 12196250.0, mailed Mar. 12, 2014, 15 pages.
Office Action dated Aug. 12, 2015 for corresponding Chinese Patent Application No. 201210574215.5, 12 pages.
Search Report dated Jul. 31, 2015 for corresponding Chinese Patent Application No. 201210574215.5, 4 pages.

* cited by examiner

LIQUID CRYSTAL DISPLAY DEVICE

The present application claims priority under 35 U.S.C. §119(a) of Korean Patent Application No. 10-2012-0030167 filed on Mar. 23, 2012, which is hereby incorporated by reference in its entirety.

BACKGROUND

1. Field of the Disclosure

The present application relates to a liquid crystal display device.

2. Description of the Related Art

A variety of display devices for displaying information are being developed. The display devices include liquid crystal display (LCD) devices, plasma display panel devices, electrophoresis display devices, organic electro-luminescence display device, and semiconductor light-emitting display devices, as examples. Among these display devices, liquid crystal display devices have the features of light weight, slimness, high brightness, full-colors, easily enlarged size and so on. As such, the liquid crystal display devices are considered to be the main trend of display devices.

FIG. 1 is a block diagram showing an LCD device of the related art.

Referring to FIG. 1, the related art LCD device includes a liquid crystal panel 1, a timing controller 10, a gate driver 20, a data driver 30, a power supplier 40, a gamma voltage generator 50 and a memory 60.

The liquid crystal panel 1 includes a plurality of gate lines GL1~GLn and a plurality of data lines DL1~DLm formed by extending along a direction crossing the plurality of gate lines GL1~GLn. The plurality of gate lines GL1~GLn and the plurality of data lines DL1~DLm crossing each other define a plurality of pixel regions. A thin film transistor 11 is formed on each pixel region. The plurality of gate lines GL1~GLn are electrically connected to the gate driver 20. The plurality of data lines DL1~DLm are electrically connected to the data driver 30.

The timing controller 10 derives gate control signals and data control signals using control signals received through an external interface. The gate control signals are used to control the gate driver 20. As such, the gate control signals are applied to the gate driver 20. The data control signals are used to control the data driver 30. As such, the data control signals are applied to the data driver 30. Also, the timing controller 10 transfers data received through the external interface to the data driver 30.

The power supplier 40 generates drive voltages necessary to drive the timing controller 10, the gate driver 20, the data driver 30 and the gamma voltage generator 50. Also, the power supplier 40 applies the drive voltages to the timing controller 10, the gate driver 20, the data driver 30 and the gamma voltage generator 50.

The memory 60 stores initial data necessary to drive the timing controller 10. The memory 60 applies the initial data to the timing controller 10 when the timing controller 10 is initially started.

The gamma voltage generator 50 generates a plurality of gamma voltages by voltage-dividing a high potential power voltage based on a low potential power voltage. The high and low potential power voltages are applied from the power supplier 40 to the gamma voltage generator 50. The plurality of gamma voltages is applied to the data driver 30. The data driver 30 converts the data received from the timing controller 10 into a data voltage by selecting at least one among the plurality of gamma voltages according to the data and adding the selected gamma voltages. Also, the data driver 30 applies the data voltages to the thin film transistors 11 through the plurality of data lines DL1~DLm and enables gray levels to be displayed.

The gamma voltage generator 50 of the related art LCD device is configured using either arrangement of resistors or an integrated circuit IC chip.

Both the method using the arrangement of resistors and the method using the IC chip must enable the gamma voltage generator 50 to be mounted on a printed circuit board PCB. Due to this, the PCB must be large-sized, and furthermore wirings connecting the PCB with the data driver 30 must be complex.

If the gamma voltage generator 50 is configured using the arrangement of resistors, it is difficult to adjust the gamma voltages. Moreover, a lot of time must be required for the adjustment of gamma voltages.

The gamma voltage generator 50 can be configured using a programmable gamma IC chip. The gamma voltage generator 50 using the IC chip becomes easier to adjust the gamma voltages compared to that using the arrangement of resistors. However, the gamma voltage generator 50 using the IC chip must include a memory, an analog-to-digital converter and an I2C bus transceiver. As such, the circuit configuration of the LCD device must be complex, and manufacturing costs of the LCD device must increase.

SUMMARY

An LCD device includes: a memory in which gamma setting data is stored; a data driver configured to include a gamma voltage generator; a timing controller configured to download the gamma setting data from the memory and apply a select signal to the gamma voltage generator; and a power supplier configured to apply reference voltages to the gamma voltage generator, wherein the select signal is used to vary a gamma curve by enabling the reference voltages to be adjusted in their levels.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EXEMPLARY EMBODIMENTS

Figure 1:
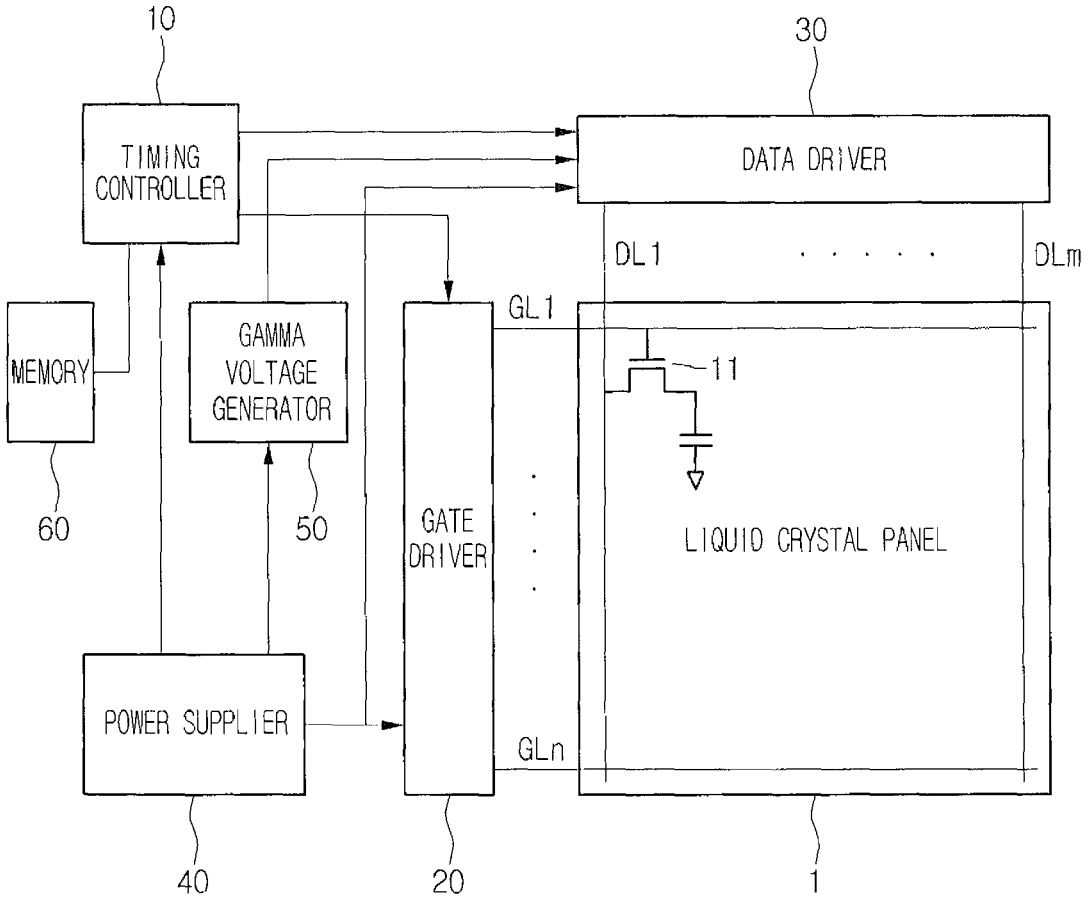
FIG. 1 is a block diagram showing an LCD device of the related art.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

Figure 2:
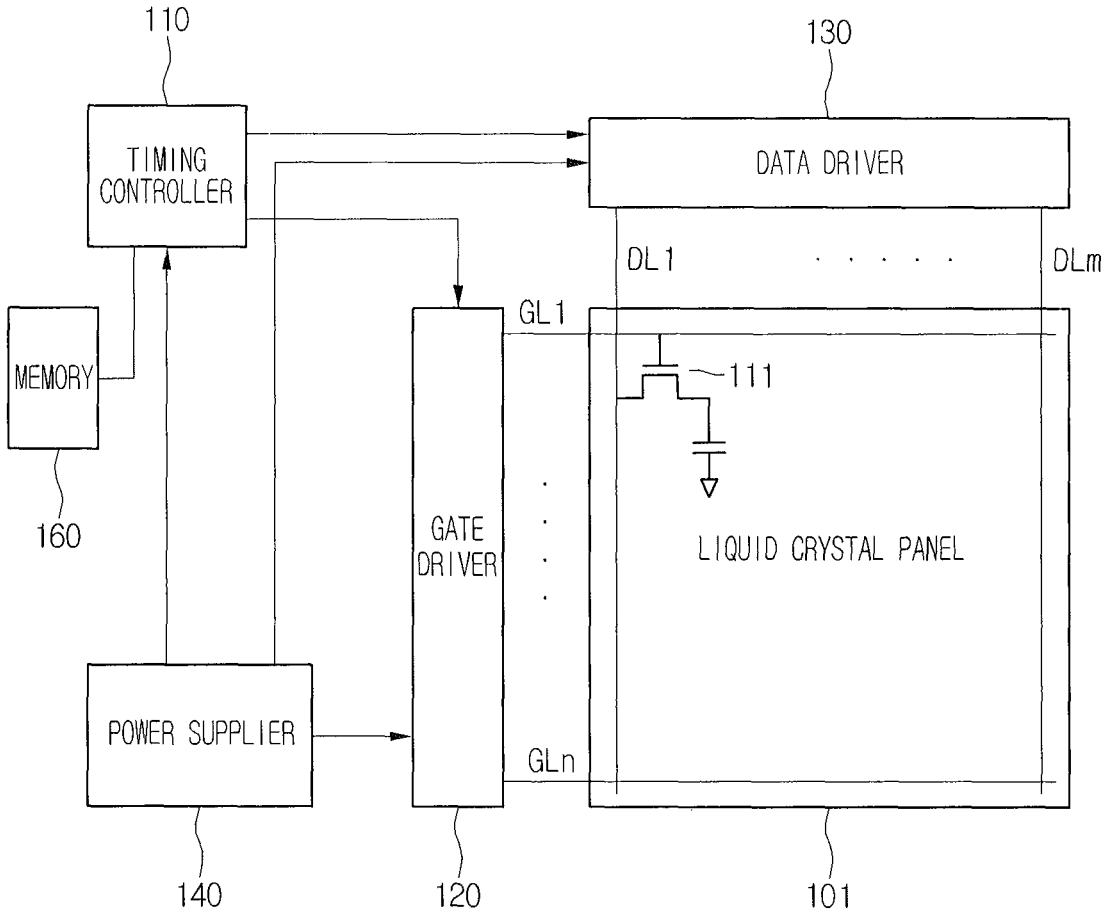
FIG. 2 is a block diagram showing an LCD device according to an embodiment of the present disclosure.

FIG. 2 is a block diagram showing an LCD device according to an embodiment of the present disclosure.

Referring to FIG. 2, the LCD device according to an embodiment of the present disclosure can include a liquid crystal panel 101, a timing controller 110, a gate driver 120, a data driver 130, a power supplier 140 and a memory 160.

A plurality of gate lines GL1~GLn can be formed on the liquid crystal panel 101. Also, a plurality of data lines DL1~DLm can be formed on the liquid crystal panel 101 by extending along a direction crossing the plurality of gate lines GL1~GLn. The plurality of gate lines GL1~GLn and the plurality of data lines DL1~DLm crossing each other can define a plurality of pixel regions. A thin film transistor 111 can be formed on each pixel region.

The thin film transistor 111 can be electrically connected to one of the gate lines GL1~GLn and one of the data lines DL1~DLm. In detail, a gate electrode of the thin film transistor 111 can be electrically connected to one of the gate lines GL1~GLn, a source electrode of the thin film transistor 111 can be electrically connected to one of the data lines DL1~DLm, and a drain electrode of the thin film transistor 111 can be electrically connected to a pixel electrode formed in the respective pixel region. The thin film transistor 111 transfers a data voltage on the respective data line to the respective pixel electrode in response to a gate signal on the respective gate line and allows an electric field to be formed in the respective pixel region, thereby displacing liquid crystal molecules. In accordance therewith, transmittance of the liquid crystal cell is adjusted, and furthermore an image is displayed.

The timing controller 110 receives digital video data RGB, a horizontal synchronous signal Hsync, a vertical synchronous signal Vsync, a clock signal CLK and so on through an external interface. Also, the timing controller 110 generates gate control signals and data control signals using the horizontal synchronous signal Hsync, the vertical synchronous signal Vsync, the clock signal CLK and so on. The gate control signals are used to control the gate driver 120. The data control signals are used to control the data driver 130.

The gate control signals are applied to gate driver 120. The data control signals and the digital video data RGB are applied to the data driver 130.

The timing controller 110 can transmit and receive data to and from the memory 160 in an Inter Integrated circuit (I2C) communication mode. The I2C communication mode corresponds to a bi-directional digital serial-communication mode providing a communication link between two modules. In detail, the I2C communication mode uses two buses transferring serial data (SDA) and serial clocks (SCL) and implements data communication. Such an I2C communication mode is currently considered as a substantial standard solution for communication between internal chips.

The memory 160 can store data necessary to drive the timing controller 110. Also, the memory 160 can store gamma setting data used to control gamma reference voltages of a gamma voltage generator. Such a memory 160 can be an EEPROM (electrically erasable and programmable read-only-memory capable of erasing and updating stored data.

The timing controller 110 can down-loads the gamma setting data used to control the gamma reference voltages of the gamma voltage generator. Also, the timing controller 110 can apply a select signal Sel to the data driver 130.

The data control signals can include a source start pulse SSP, a source shift clock SSC, a source output enable signal SOE, a polarity signal POL, the select signal Sel and so on. The source start pulse SSP is used to control a supply start time point for one line of data every horizontal period. The source shift clock SSC is used to sequentially control a supply time point of the data. The source output enable signal SOE is used to control a supply time point for one line of data voltages which are applied from the data driver to the liquid crystal panel 101. The polarity signal POL is used to select polarities of the data voltages. In other words, the polarity signal POL enables each of the data voltages to selectively have one of a positive level and a negative level. The select signal Sel is used to vary the gamma reference voltage. The select signal can be a 3-bit digital signal.

The gate control signals can include a gate start pulse GSP, a gate shift clock GSC and a gate output enable signal GOE. The gate start pulse GSP is used to control a driving start time point of the first gate line GL1 of the liquid crystal panel 101 in every frame. The gate shift clock GSC is used to sequentially control driving start time points of the gate lines GL1~GLn of the liquid crystal panel 101. The gate output enable signal GOE is used to control time points when the gate signals are applied to the respective gate lines GL1~GLn.

The gate driver 120 controls the thin film transistors 111 on the liquid crystal panel 101 to be turned-on/off, in response to the gate control signals applied from the timing controller 110. To this end, the gate driver 120 sequentially enables the gate lines GL1~GLn on the liquid crystal panel 101. As such, the thin film transistors 111 on the liquid crystal panel 101 are sequentially turned-on in a single line and allow the data voltages applied from the data driver 130 to be transferred to the pixel electrodes, which are connected to the turned-on thin film transistors 111.

The data driver 130 receives the data control signals and the digital video data RGB from the timing controller 110. Also, the data driver 130 can apply data voltages to the plurality of data lines DL1~DLm.

The power supplier 140 can generate direct-current drive voltages necessary to drive the LCD device. Also, the power supplier 140 can apply the drive voltages to the timing controller 110, the gate driver 120 and the data driver 130.

Such data driver 130 and power supplier 140 will now be explained in detail referring to FIG. 3 through 5.

Figure 3:
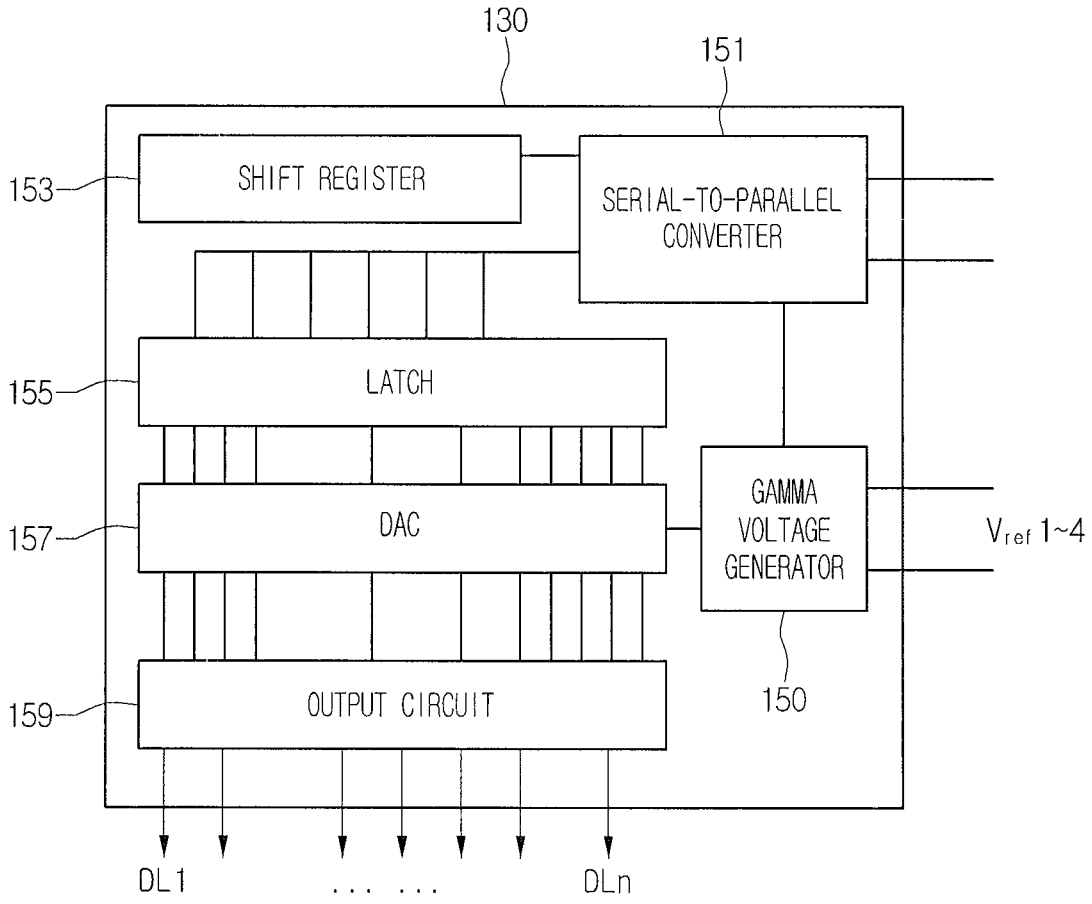
FIG. 3 is a detailed block diagram showing a data driver of the LCD device according to an embodiment of the present disclosure.

FIG. 3 is a detailed block diagram showing a data driver of the LCD device according to an embodiment of the present disclosure.

Referring to FIG. 3, the data driver 130 of the LCD device according to an embodiment of the present disclosure can include a serial-to-parallel converter 151, a shift register 153, a latch 155, a digital-to-analog converter (DAC) 157 and an output circuit 159.

The serial-to-parallel converter 151 can convert the digital video data serially received from the timing controller 110 into a parallel data format and apply the parallel digital video data to the latch 155. Also, the serial-to-parallel converter 151 can transfer the select signal Sel applied from the timing controller 110 to a gamma voltage generator 150.

The shift register 153 generates a sampling signal using the source start pulse SSP and the source shift clock SSC applied from the timing controller 110. The sampling signal is applied to the serial-to-parallel converter 151. The sampling signal is used to control the serial-to-parallel converter 151 to convert the serial digital video data into the parallel data format.

The latch 155 replies to the source output enable signal SOE applied from the timing controller 110 and latches a single line of parallel digital video data RGB applied from the serial-to-parallel converter 151. The single line of parallel digital video data RGB can be applied from the latch 155 to the DAC 157.

The gamma voltage generator 150 can generate a plurality of gamma voltages by voltage-dividing a power voltage applied from the power supplier 140 and supply the plurality of gamma voltages to the DAC 157. Also, the gamma voltage generator 150 can adjust the gamma voltages on the basis of the select signal Sel applied from the serial-to-parallel converter 151. The power voltage can include a plurality of reference voltages voltage-divided by the power supplier 140. The plurality of reference voltages can include four reference voltages with different levels from one another. In other words, the plurality of reference voltages can include first through fourth reference voltages Vref1 through Vref4.

The gamma voltage generator 150 is formed within the data driver 130, thereby preventing enlargement of the PCB. Also, the gamma voltage generator 150 stores necessary data in an un-used storage area of the memory 160 instead of a separated storage space using the I2C communication between the timing controller 110 and the memory 160. As such, the gamma voltage generator 150 can be simplified, and furthermore manufacturing costs of the LCD device can be reduced. Moreover, it is not necessary to form a separated wiring because the select signal Sel is included in the data control signals.

The DAC 157 can converts the digital video data RGB applied from the latch 155 into the data voltages, corresponding to analog signals, using the gamma voltages applied from the gamma voltage generator 150. To this end, the DAC 157 selects at least one among the gamma voltages on the basis of the digital video data and performs an addition operation for the at least one selected gamma voltage. The data voltages converted by the DAC 157 can be applied to the output circuit 159.

The output circuit 159 can transfer the data voltages received from the DAC 157 to the plurality of data lines DL1~DLm. The output circuit 159 can include a plurality of output buffers connected to the plurality of data lines DL1~DLm. Each of the output buffers can have a function of preventing attenuation of the data voltage which can be caused by resistances of the respective data line and the respective pixel region.

Figure 4:
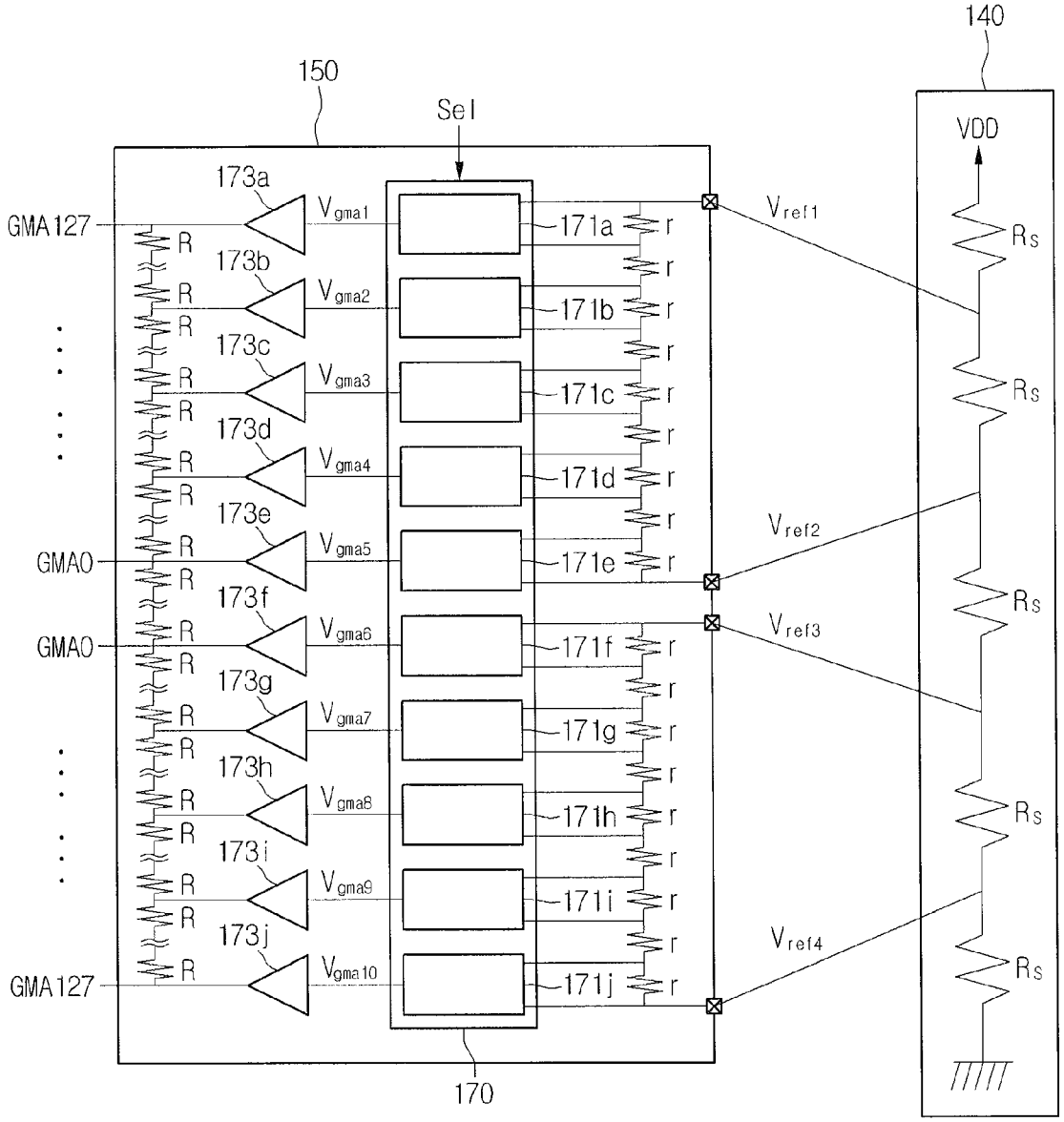
FIG. 4 is a circuit diagram showing a gamma voltage generator and a power supplier according to a first embodiment of the present disclosure.

FIG. 4 is a circuit diagram showing a gamma voltage generator and a power supplier according to a first embodiment of the present disclosure.

Referring to FIG. 4, the power supplier 140 according to a first embodiment of the present disclosure can include a plurality of power resistors Rs. The power resistors Rs can be serially connected to one another. A power voltage VDD can be applied to one end of the serial circuit of the power resistors Rs. Also, a ground voltage GND can be applied to the other end of the serial circuit of the power resistors Rs.

The plurality of power resistors Rs can voltage-divide the power voltage VDD and apply a plurality of reference voltages to the gamma voltage generator 150. For example, when the power supplier 140 includes 5 serially connected power resistors Rs, first through fourth reference voltages voltage-divided by the power resistors Rs can be applied to the gamma voltage generator 150.

The gamma voltage generator 150 can derive a plurality of gamma voltages from the first through fourth reference voltages Vref1 through Vref4. The gamma voltages can include positive gamma voltages and negative gamma voltages.

The gamma voltage generator 150 can include a plurality of input resistors "r", a decoder portion 170, a plurality of buffers 173 and a plurality of gamma resistors R.

The decoder portion 170 can include a plurality of decoders. As an example, the decoder portion 170 can include first through tenth decoders 171*a* through 171*j*.

The plurality of input resistors 'r' can be grouped into two serial circuits. The first and second reference voltages Vref1 and Vref2 can be applied to both ends of a first serial circuit of the input resistors 'r'. The first serial circuit of the input resistors 'r' can voltage-divide a voltage difference between the first and second reference voltages Vref1 and Vref2 and apply the divided voltages to the decoder portion 170. For example, the first serial circuit of the input resistors 'r' can voltage-divide the first reference voltage Vref1 based on the second voltage Vref2 and apply the divided voltages to the first through fifth decoders 171*a* through 171*e*.

The third and fourth reference voltages Vref3 and Vref4 can be applied to both ends of a second serial circuit of the input resistors 'r'. The second serial circuit of the input resistors 'r' can voltage-divide a voltage difference between the third and fourth reference voltages Vref3 and Vref4 and apply the divided voltages to the decoder portion 170. For example, the second serial circuit of the input resistors 'r' can voltage-divide the third reference voltage Vref3 based on the fourth voltage Vref4 and apply the divided voltages to the sixth through tenth decoders 171*f* through 171*j*.

The decoder portion 170 can receive the select signal Sel from the timing controller 110 through the serial-to-parallel converter 151. Each of the decoders 171*a* through 171*j* within the decoder portion 170 can input the select signal Sel and two divided voltages, which have different levels from each other and are voltage-divided by the input resistors 'r', and output a single gamma reference voltage Vgma. The two divided voltages input to each decoder 171 can set up an adjustable level range of the single gamma reference voltage Vgma. In other words, the two divided voltages can become maximum and minimum values of the adjustable level range for each gamma reference voltage Vgma.

Each decoder 171 can selects one of voltage values between the two divided voltages with the different levels from each other in response to the select signal Sel and output the selected voltage value as a gamma reference voltage Vgma. Each of the gamma voltage can be adjusted within a fixed voltage range under according to the select signal Sel. As such, it is easy to adjust the gamma voltages. Furthermore, a gamma curve property can be easily adjusted along the data applied from the timing controller 110.

The decoder 171 can convert a small number of bits of data into a large number of bits of data. For example, the decoder 171 can be a 3-to-8 (3×8) decoder. In this case, the decoder 171 can select one of 8 voltages, which are included in the fixed voltage range between the two divided voltages with the different levels from each other, and output the selected voltage as a gamma reference voltage Vgma. If the select signal Sel has a logic value of '000', the decoder 171 selects a minimum voltage of the eight voltages between the two divided voltages with the different levels from each other and outputs the minimum voltage as a gamma reference voltage Vgma. When the select signal Sel has another logic value of '111', the decoder 171 selects a maximum voltage of the eight voltages between the two divided voltages with the different levels from each other, and outputs the maximum voltage as a gamma reference voltage Vgma. In this manner, the single gamma reference voltage Vgma can selectively have a plurality of voltage levels under the control of the decoder 171. In other words, the decoder 171 can selectively output the plural voltages having different levels from one another as a gamma reference voltage Vgma. As such, it is possible to finely adjust the gamma curve property.

The decoder portion 170 can apply the gamma reference voltages Vgma to the plurality of buffers 173. The first decoder 171*a* can apply a first gamma reference voltage Vgma1 to a first buffer 173*a*, the second decoder 171*b* can apply a second gamma reference voltage Vgma2 to a second buffer 173*b*, the third decoder 171*c* can apply a third gamma reference voltage Vgma3 to a third buffer 173*c*, the fourth decoder 171*d* can apply a fourth gamma reference voltage Vgma4 to a fourth buffer 173*d*, the fifth decoder 171*e* can apply a fifth gamma reference voltage Vgma5 to a fifth buffer 173*e*, the sixth decoder 171*f* can apply a sixth gamma reference voltage Vgma6 to a sixth buffer 173*f*, the seventh decoder 171*g* can apply a seventh gamma reference voltage Vgma7 to a seventh buffer 173*g*, the eighth decoder 171*h* can apply an eighth gamma reference voltage Vgma8 to an eighth buffer 173*h*, the ninth decoder 171*i* can apply a ninth gamma reference voltage Vgma9 to a ninth buffer 173*i*, and the tenth decoder 171*j* can apply a tenth gamma reference voltage Vgma10 to a tenth buffer 173*j*.

The plurality of buffers 173 can apply the first through tenth gamma reference voltages Vgma1 through Vgma10 to a serial circuit of gamma resistors 'R'. The buffers 173 can serve the function of applying stable gamma reference voltages by preventing the influence of the load model caused by the plurality of gamma resistors 'R'.

The plurality of gamma resistors 'R' can generate a plurality of gamma voltages GMA by voltage-dividing the plurality of gamma reference voltages Vgma. For example, the plurality of gamma resistors 'R' can voltage-divide the first through tenth gamma reference voltages Vgma1 through Vgma10 and generate 256 gamma voltages GMA with different levels from one another. The plurality of gamma voltages GMA can be grouped into first and second sets. The first and second gamma voltage sets each include 128 gamma voltages GMA0 through GMA127. Also, the plurality of gamma voltages GMA can be grouped into a positive gamma voltage set and a negative gamma voltage set. The positive gamma voltage set can be generated by voltage-dividing the first through fifth gamma reference voltages Vgma1~Vgma5. Also, the positive gamma voltage set can become the first gamma voltage set. The negative gamma voltage set can be generated by voltage-dividing the sixth through tenth gamma reference voltages Vgma6~Vgma10. Also, the negative gamma voltage set can become the second gamma voltage set.

Figure 5:
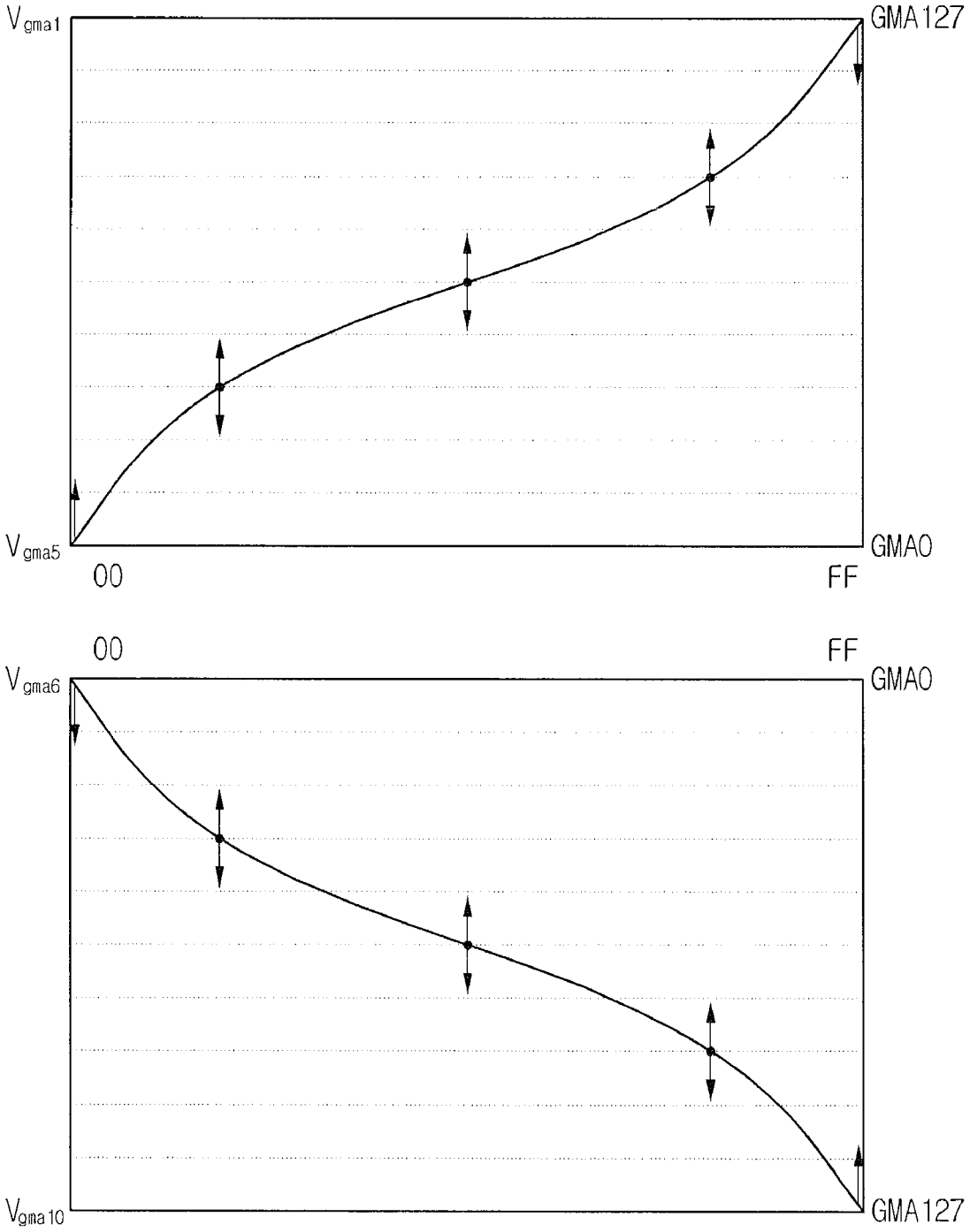
FIG. 5 is a data sheet illustrating a gamma curve characteristic of the gamma voltage generator in accordance with a first embodiment of the present disclosure.

FIG. 5 is a data sheet illustrating a gamma curve characteristic of the gamma voltage generator in accordance with a first embodiment of the present disclosure.

As shown in FIG. 5, the gamma curve characteristic of the gamma voltage generator 150 according to a first embodiment of the present disclosure can be defined into the positive gamma voltages derived from the first through fifth gamma reference voltages Vgma1~Vgma5 and the negative gamma voltages derived from the sixth through tenth gamma reference voltages Vgma6~Vgma10.

The gamma voltage generator 150 according to a first embodiment of the present disclosure can allow the decoder portion 170 to vary the levels of each gamma reference voltage alone the select signal. Such variation of each gamma reference voltage enables the gamma curve characteristic to be easily adjusted. As such, the gamma voltage generator of the present embodiment can be easier to adjust the gamma curve characteristic compared to the related art gamma voltage generator using a resistor train mode. Moreover, the gamma voltage generator of the present embodiment can adjust the gamma curve characteristic using the existing components such as a memory and so on. In accordance therewith, the gamma voltage generator of the present embodiment can more simplify the circuit configuration compared to the related art gamma generator using a programmable gamma IC chip. Furthermore, the present embodiment can reduce manufacturing costs of the LCD device.

Figure 6:
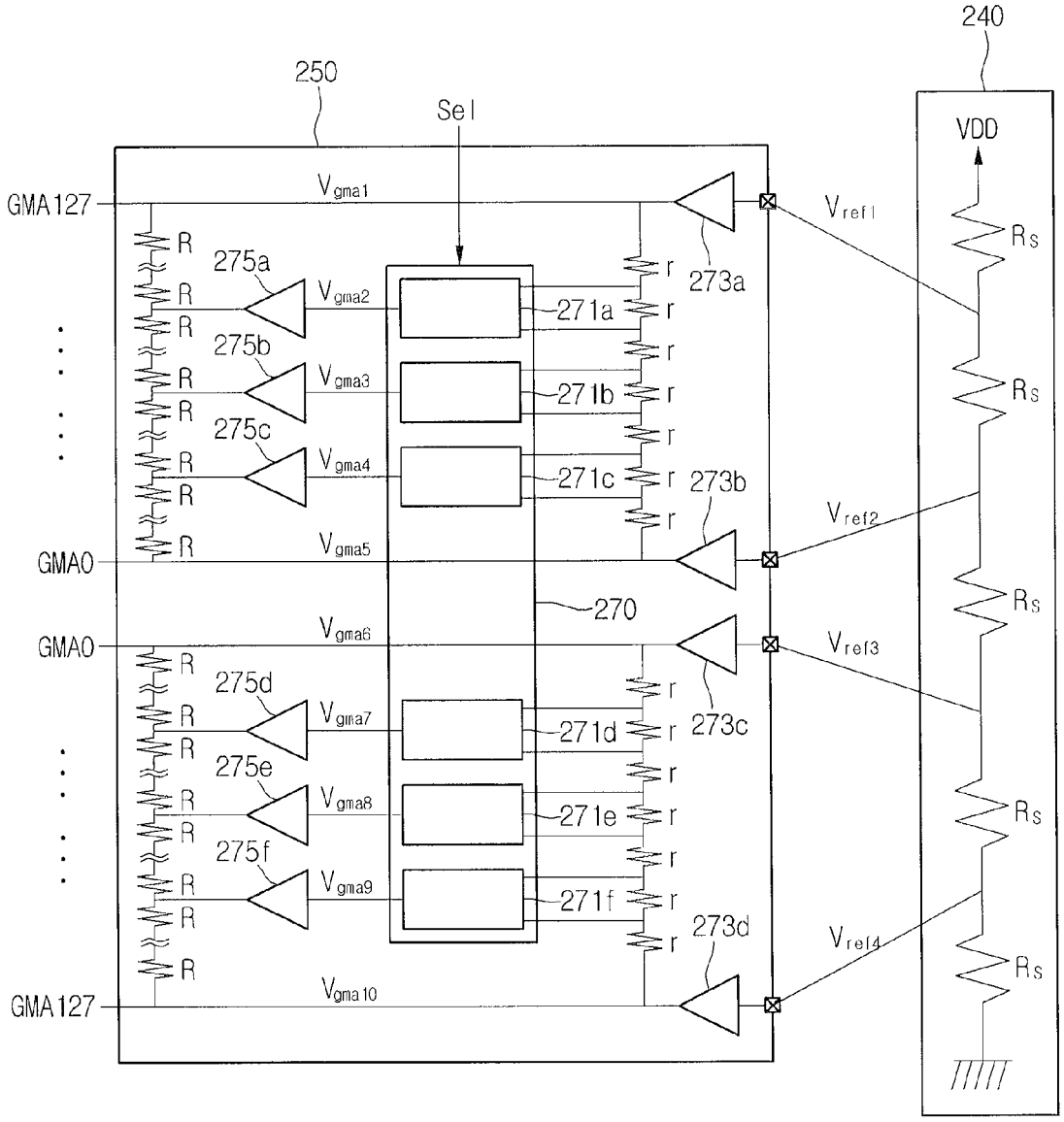
FIG. 6 is a circuit diagram showing a gamma voltage generator and a power supplier according to a second embodiment of the present disclosure.

FIG. 6 is a circuit diagram showing a gamma voltage generator and a power supplier according to a second embodiment of the present disclosure.

The gamma voltage generator and the power supplier of the second embodiment have the same configurations as those of the first embodiment, with the exception of differences in the configurations of the buffers and the decoder portion. Accordingly, the description of the first embodiment to be repeated in the second embodiment will be omitted.

Referring to FIG. 6, the power supplier 240 according to a second embodiment of the present disclosure can include a plurality of power resistors Rs. The power resistors Rs can be serially connected to one another between a power voltage VDD and a ground voltage GND.

The plurality of power resistors Rs can voltage-divide the power voltage VDD and apply a plurality of reference voltages to the gamma voltage generator 150. For example, when the power supplier 240 includes 5 serially connected power resistors Rs, first through fourth reference voltages voltage-divided by the power resistors Rs can be applied to the gamma voltage generator 250.

The gamma voltage generator 250 can derive a plurality of gamma voltages from the first through fourth reference voltages Vref1 through Vref4. The gamma voltages can include positive gamma voltages and negative gamma voltages.

The gamma voltage generator 250 can include a plurality of input buffers 273, a plurality of input resistors 'r', a decoder portion 270, a plurality of output buffers 275 and a plurality of gamma resistors R.

The first through fourth reference voltages Vref1~Vref4 can be applied to the plurality of input buffers 273. The plurality of input buffers 273 can serve the function of applying stable gamma reference voltages by preventing the influence of the load model caused by the pluralities of input resistors 'r' and gamma resistors 'R'.

The first reference voltage Vref1 can be applied to a first input buffer 273*a*. The second reference voltage Vref2 can be applied to a second input buffer 273*b*. The third reference voltage Vref3 can be applied to a third input buffer 273*c*. The fourth reference voltage Vref4 can be applied to a fourth input buffer 273*d*.

As the plurality of reference voltages Vref is applied to the input buffers 273 within the gamma voltage generator 250, the resistance influences caused by lines used to connect the power supplier 240 and the gamma voltage generator 250 can be reduced. In other words, the supply of the unstable reference voltages Vref due to the non-uniform of the line resistances can be prevented. The input buffers can have a big effect on a COG (chip-on-glass) mode liquid crystal panel with a large line resistance. The COG mode liquid crystal panel means a liquid crystal panel loaded with the data driver.

The plurality of input resistors 'r' can be grouped into two serial circuits. Also, the plurality of input resistors 'r' can performs the voltage division for the first through fourth reference voltages Vref1~Vref4 and apply divided voltages to the decoder portion 270.

Each of decoders 271 included in the decoder portion 270 can input the select signal applied from timing controller 110 and two divided voltages which have different levels from each other and are voltage-divided by the input resistors 'r'. Also, each of the decoders 271 can output a single gamma reference voltage Vgma.

The gamma reference voltages can be applied to the plurality of gamma resistors 'R', serially connected to one another, through the plurality of output buffers 275. The gamma resistors 'R' can generate positive gamma voltages and negative gamma voltages by voltage-dividing the gamma voltages Vgma.

The first reference voltage Vref1 can be applied to one end of a serial circuit of the input resistors 'r'. Also, the first reference voltage Vref1 can be provided as a first gamma reference voltage Vgma1 and a positive gamma voltage GMA127 with a most significant gray level.

The second reference voltage Vref2 can be applied to the other end of a serial circuit of the input resistors 'r'. Also, the second reference voltage Vref2 can be provided as a fifth gamma reference voltage Vgma5 and a positive gamma voltage GMA0 with a least significant gray level.

The third reference voltage Vref3 can be applied to one end of another serial circuit of the input resistors 'r'. Also, the third reference voltage Vref3 can be provided as a sixth gamma reference voltage Vgma6 and a negative gamma voltage GMA0 with a least significant gray level.

The fourth reference voltage Vref4 can be applied to the other end of another serial circuit of the input resistors 'r'. Also, the fourth reference voltage Vref4 can be provided as a tenth gamma reference voltage Vgma10 and a negative gamma voltage GMA127 with a most significant gray level.

The first gamma reference voltage Vref1, the fifth gamma reference voltage Vref5, the sixth gamma reference voltage Vref6 and the tenth gamma reference voltage Vref10 can be directly provided as gamma voltages without passing through the decoder portion 270 and the output buffers 275.

Since the first gamma reference voltage Vref1, the fifth gamma reference voltage Vref5, the sixth gamma reference voltage Vref6 and the tenth gamma reference voltage Vref10 are directly provided as gamma voltage, the gamma voltage generator 250 of the second embodiment can reduce the number of decoders, the size of the integrated circuit and manufacturing costs of the LCD device, compared to that of the first embodiment.

Moreover, the second embodiment can reduce line resistances between the power supplier 240 and the gamma voltage generator 250 using the same buffers as the first embodiment. As such, the gamma voltage generator of the second embodiment can provide not only stable reference voltages but also a stable gamma curve characteristic, which is derived from the stable reference voltages.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

a memory in which gamma setting data is stored;

a data driver configured to include a gamma voltage generator;

a timing controller configured to download the gamma setting data from the memory and apply a select signal to the gamma voltage generator; and a power supplier configured to apply reference voltages to the gamma voltage generator, wherein the select signal is used to vary a gamma curve by enabling the reference voltages to be adjusted in their levels, wherein the gamma voltage generator includes:

a plurality of decoders, wherein the select signal is applied to the decoders for adjusting the levels of the reference voltages;

a plurality of input resistors configured to voltage-divide the reference voltages and apply divided voltages to the decoders, the input resistors being grouped into a first serial circuit and a second serial circuit, wherein the first and second serial circuit each have a fixed resistance so that the divided voltages applied to the decoders are fixed;

a plurality of buffers configured to transfer gamma reference voltages output from the decoders; and a plurality of gamma resistors configured to voltage-divide the gamma reference voltages applied from the buffers and generate gamma voltages, wherein the gamma resistors generate positive gamma voltages and negative gamma voltages by voltage-dividing the gamma reference voltages, wherein the power supply supplies a first reference voltage and a second reference voltage to ends of the first serial circuit and supplies a third reference voltage and a fourth reference voltage to ends of the second serial circuit, the first and second reference voltages providing a positive gamma voltage with a most significant gray level and a positive gamma voltage with a least significant gray level, respectively, the third and fourth reference voltages providing a negative gamma voltage with a least significant gray level and a negative gamma voltage with a most significant gray level, respectively, wherein the first, second, third, and fourth reference voltages are all different and larger than a ground voltage, wherein the plurality of buffers are divided into a first group corresponding to the first serial circuit and a second group corresponding to the second serial circuit, and wherein the plurality of decoders each receive two of the divided voltages that are fixed from the plurality of input resistors, and the plurality of decoders each receive the select signal including a logic value and output one of the gamma reference voltages that corresponds to the logic value of the select signal and that is between the two of the divided voltages applied to a corresponding decoder.

2. The liquid crystal display device of claim 1, wherein the decoder is a 3-to-8 decoder.

3. The liquid crystal display device of claim 1, wherein the decoder selects one of divided voltages, which have different levels from one another and are applied from the input resistors, in response to the select signal and output the selected voltage as a gamma reference voltage.

4. The liquid crystal display device of claim 1, wherein the timing controller transmits and receives the data to and from the memory in an inter integrated circuit (I2C) communication mode.

5. The liquid crystal display device of claim 1, wherein the memory includes an electrically erasable and programmable read-only-memory (EEPROM).

6. The liquid crystal display device of claim 1, wherein the power supplier includes a plurality of resistors serially connected to one another, and configured to generate the reference voltages by voltage-dividing the power voltage.

7. The liquid crystal display device of claim 1, wherein gamma voltage generator further includes input buffers configured to transfer the reference voltages applied from the power supplier to the plurality of input resistors and provide the reference voltages as gamma voltages with most and least significant gray levels.

8. The liquid crystal display device of claim 1, wherein the data driver is formed in a chip-on-glass (COG) mode.

9. The liquid crystal display device of claim 1, wherein the plurality of gamma voltages are grouped into a first gamma voltage set including the positive gamma voltages and a second gamma voltage set including the negative gamma voltages.

10. The liquid crystal display device of claim 2, wherein the 3-to-8 decoder selects one of 8 voltages, which are included in the fixed voltage range between the two divided voltages with the different levels from each other, and outputs the selected voltage as a gamma reference voltage.

* * * * *